US008807561B2

(12) United States Patent
Hongo et al.

(10) Patent No.: US 8,807,561 B2
(45) Date of Patent: Aug. 19, 2014

(54) PAPER CONVEYING APPARATUS, JAM DETECTION METHOD, AND COMPUTER-READABLE, NON-TRANSITORY MEDIUM

(71) Applicant: PFU Limited, Kahoku (JP)

(72) Inventors: Masanobu Hongo, Kahoku (JP); Takayuki Umi, Kahoku (JP)

(73) Assignee: PFU Limited, Kahoku-shi (JP)

( * ) Notice: Subject to any disclaimer, the term of this patent is extended or adjusted under 35 U.S.C. 154(b) by 0 days.

(21) Appl. No.: 13/963,701

(22) Filed: Aug. 9, 2013

(65) Prior Publication Data

US 2014/0054852 A1 Feb. 27, 2014

(30) Foreign Application Priority Data

Aug. 24, 2012 (JP) ..... 2012-185355

(51) Int. Cl.

| | |
|---|---|
| ***B65H 7/02*** | (2006.01) |
| ***B65H 5/00*** | (2006.01) |
| ***B41J 11/00*** | (2006.01) |
| ***G03G 15/00*** | (2006.01) |

(52) U.S. Cl.

CPC ..... *B65H 5/00* (2013.01); *B65H 2513/10* (2013.01); *B65H 2515/82* (2013.01); *B65H 7/02* (2013.01); *B41J 11/006* (2013.01); *B65H 2511/528* (2013.01); *B65H 2557/63* (2013.01); *G03G 2215/00637* (2013.01); *G03G 15/70* (2013.01)

USPC ..... 271/265.01; 271/265.02; 271/270

(58) Field of Classification Search

CPC ..... B65H 2511/528; B65H 2515/82; B65H 2557/112

USPC ..... 271/265.01, 265.02, 265.03, 270

See application file for complete search history.

(56) References Cited

U.S. PATENT DOCUMENTS

| | | | |
|---|---|---|---|
| 4,022,460 | A | 5/1977 | Pritchett |
| 7,934,722 | B2 | 5/2011 | Namikawa |

(Continued)

FOREIGN PATENT DOCUMENTS

| | | |
|---|---|---|
| JP | 57-169767 | 10/1982 |
| JP | 60-112547 | 6/1985 |

(Continued)

OTHER PUBLICATIONS

Office action mailed Jul. 9, 2013 for JP 2012-185273 including English translation, 7pp.

Office action mailed Jul. 9, 2013 for JP 2012-185355 including English translation, 5pp.

Office action mailed Jul. 9, 2013 for JP 2012-185358 including English translation, 4pp.

(Continued)

*Primary Examiner* — Michael McCullough

*Assistant Examiner* — Howard Sanders

(74) *Attorney, Agent, or Firm* — Christie, Parker & Hale, LLP

(57) ABSTRACT

There are provided a paper conveying apparatus, a jam detection method and a computer-readable, non-transitory medium which can precisely determine any occurrence of a jam by a sound regardless of the conveyance speed of the paper. The paper conveying apparatus includes a sound signal generator for generating a sound signal corresponding to a sound generated by a paper during conveyance of the paper, a corrected signal generator for correcting the sound signal to generate a corrected signal, and a sound jam detector for determining whether a jam has occurred based on the corrected signal, wherein the corrected signal generator sets a method of correcting the sound signal in accordance with conveyance speed information.

9 Claims, 15 Drawing Sheets

(56) References Cited

U.S. PATENT DOCUMENTS

| | | | | |
|---|---|---|---|---|
| 8,567,777 | B2 | 10/2013 | Syracuse et al. | |
| 8,585,050 | B2 | 11/2013 | Syracuse et al. | |
| 2003/0006550 | A1* | 1/2003 | Chujo et al. | 271/262 |
| 2005/0269759 | A1* | 12/2005 | Sano et al. | 271/3.01 |
| 2007/0070456 | A1 | 3/2007 | Nishimura | |
| 2008/0224390 | A1 | 9/2008 | Ma et al. | |
| 2009/0022536 | A1 | 1/2009 | Takeshita et al. | |
| 2009/0190939 | A1 | 7/2009 | Satoh et al. | |
| 2010/0272460 | A1 | 10/2010 | Zona et al. | |
| 2011/0238423 | A1 | 9/2011 | Schaertel et al. | |
| 2012/0235929 | A1 | 9/2012 | Hongo et al. | |
| 2013/0093136 | A1 | 4/2013 | Sakharshete et al. | |
| 2013/0140757 | A1 | 6/2013 | Phinney et al. | |
| 2013/0140766 | A1 | 6/2013 | Syracuse et al. | |
| 2014/0054841 | A1 | 2/2014 | Morikawa et al. | |
| 2014/0054849 | A1 | 2/2014 | Morikawa et al. | |
| 2014/0054851 | A1 | 2/2014 | Morkiawa et al. | |
| 2014/0061995 | A1 | 3/2014 | Shimazu | |
| 2014/0062008 | A1 | 3/2014 | Hongo et al. | |
| 2014/0062009 | A1 | 3/2014 | Hongo et al. | |
| 2014/0077445 | A1 | 3/2014 | Morikawa et al. | |
| 2014/0077446 | A1 | 3/2014 | Hongo et al. | |

FOREIGN PATENT DOCUMENTS

| | | |
|---|---|---|
| JP | 61-169983 | 7/1986 |
| JP | 10-267742 | 10/1998 |
| JP | 11-053602 | 2/1999 |
| JP | 2001-302021 | 10/2001 |
| JP | 2002-205449 | 7/2002 |
| JP | 2003-295707 | 10/2003 |
| JP | 2006-322947 | 11/2006 |
| JP | 2007-079263 | 3/2007 |
| JP | 2008-290288 | 12/2008 |
| JP | 2009-249046 | 10/2009 |
| JP | 2011-112665 | 6/2011 |
| JP | 2012-131579 | 7/2012 |

OTHER PUBLICATIONS

Office action mailed Jul. 9, 2013 for JP 2012-185378 including English translation, 8pp.

Office action mailed Jul. 9, 2013 for JP 2012-203466 including English translation, 7pp.

Office action mailed Jul. 9, 2013 for JP 2012-203557 including English translation, 7pp.

* cited by examiner

PAPER CONVEYING APPARATUS, JAM DETECTION METHOD, AND COMPUTER-READABLE, NON-TRANSITORY MEDIUM

CROSS-REFERENCE TO RELATED APPLICATIONS

This application is based upon and claims the benefit of priority of prior Japanese Patent Application No. 2012-185355, filed on Aug. 24, 2012, the entire contents of which are incorporated herein by reference.

TECHNICAL FIELD

Embodiments discussed in the present specification relate to paper conveying technology.

BACKGROUND

In a paper conveying apparatus of an image reading apparatus, image copying apparatus, etc., sometimes a jam occurs when the paper moves along the conveyance path. In general, a paper conveying apparatus is provided with the function of determining whether a jam has occurred by a paper being conveyed to a predetermined position inside the conveyance path within a predetermined time from the start of conveyance of the paper and of stopping the operation of the apparatus when a jam has occurred.

On the other hand, if a jam occurs, a large sound is generated in the conveyance path, so the paper conveying apparatus can determine whether a jam has occurred based on the sound which is generated on the conveyance path and thereby detect the occurrence of a jam without waiting for the elapse of the predetermined time.

A jam detection device of a copier which converts a sound which is generated on a conveyance path to an electrical signal and determines that a jam has occurred when the time during which a reference level is exceeded exceeds a reference value has been disclosed (see Japanese Laid-Open Patent Publication No. 57-169767).

SUMMARY

Since the sound which is generated on the conveyance path differs depending on the conveyance speed of the paper, the optimum detection method of a jam differs depending on the conveyance speed of the paper.

Accordingly, it is an object of the present invention to provide a paper conveying apparatus and a jam detection method that can precisely determine any occurrence of a jam by a jam sound regardless of the conveyance speed of the paper and a computer-readable, non-transitory medium storing a computer program for causing a computer to implement such a jam detection method.

According to an aspect of the apparatus, there is provided a paper conveying apparatus. The paper conveying apparatus includes a sound signal generator for generating a sound signal corresponding to a sound generated by a paper during conveyance of the paper, a corrected signal generator for correcting the sound signal to generate a corrected signal, and a sound jam detector for determining whether a jam has occurred based on the corrected signal, wherein the corrected signal generator sets a method of correcting the sound signal in accordance with conveyance speed information.

According to an aspect of the method, there is provide a jam detection method. The jam detection method includes acquiring a sound signal corresponding to a sound generated by a paper during conveyance of the paper, acquiring conveyance speed information of a paper, correcting, by a computer, the sound signal to generate a corrected signal, determining whether a jam has occurred based on the corrected signal, and setting by the computer a method of correcting the sound signal in accordance with the conveyance speed information.

According to an aspect of the computer-readable, non-transitory medium storing a computer program, the computer program causes a computer to execute a process, including acquiring a sound signal corresponding to a sound generated by a paper during conveyance of the paper, acquiring conveyance speed information of a paper, correcting the sound signal to generate a corrected signal, determining whether a jam has occurred based on the corrected signal, and setting by the computer a method of correcting the sound signal in accordance with the conveyance speed information.

The object and advantages of the invention will be realized and attained by means of the elements and combinations particularly pointed out in the claims. It is to be understood that both the foregoing general description and the following detailed description are exemplary and explanatory and are not restrictive of the invention, as claimed.

DESCRIPTION OF EMBODIMENTS

Hereinafter, a paper conveying apparatus, jam detection method, and computer program according to an embodiment, will be described with reference to the drawings. However, note that the technical scope of the invention is not limited to these embodiments and extends to the inventions described in the claims and their equivalents.

Figure 1:
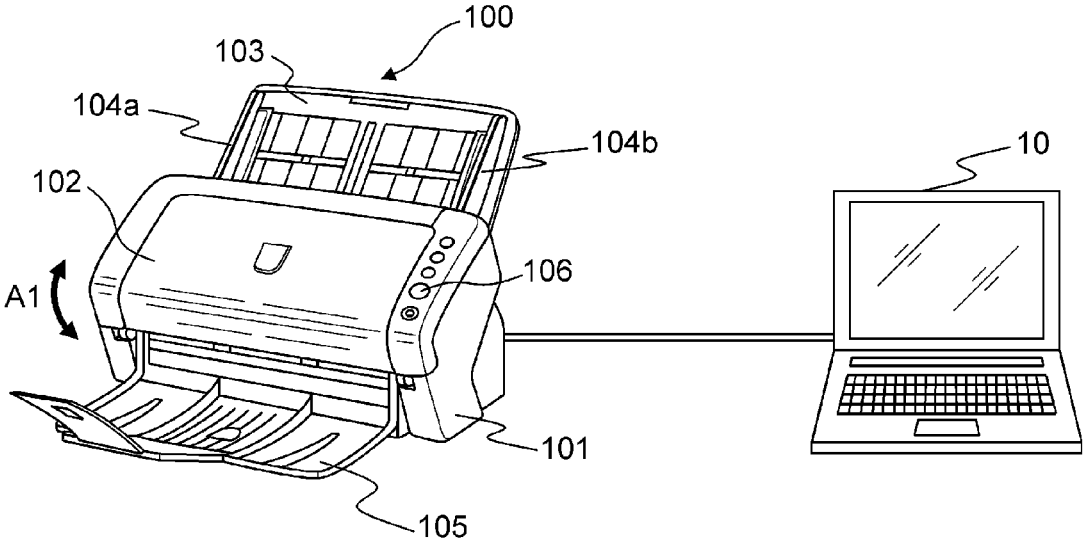
FIG. 1 is a perspective view which shows a paper conveying apparatus 100 and image processing apparatus 10 according to an embodiment.

FIG. 1 is a perspective view which shows a paper conveying apparatus 100 which are configured as an image scanner, and an information processing apparatus 10, according to an embodiment.

The paper conveying apparatus 100 includes a lower housing 101, an upper housing 102, a paper tray 103, an ejection tray 105, an operation button 106, etc., and is connected to an information processing apparatus (for example, personal computer, portable data terminal, etc.)

The lower housing 101 and the upper housing 102 are formed by plastic material. The upper housing 102 is arranged at a position which covers the top surface of the paper conveying apparatus 100 and is engaged with the lower housing 101 by hinges so as to be able to be opened and closed at the time of a paper jam, at the time of cleaning of the inside of the paper conveying apparatus 100, etc.

The paper tray 103 is engaged with the lower housing 101 in a manner enabling a paper to be placed. The paper tray 103 is provided with side guides 104*a* and 104*b* which can be moved in a direction perpendicular to a conveyance direction of the paper, that is, to the left and right directions from the conveyance direction of the paper. By positioning the side guides 104*a* and 104*b* to match with the width of the paper, it is possible to limit the width direction of the paper.

The ejection tray 105 is engaged with the lower housing 101 by hinges so as to be able to pivot in the direction which is shown by an arrow mark A1. In the opened state as shown in FIG. 1, the ejected paper can be held.

The operation button 106 is arranged on the surface of the upper housing 102. If pushed, it generates and outputs an operation detection signal.

Figure 2:
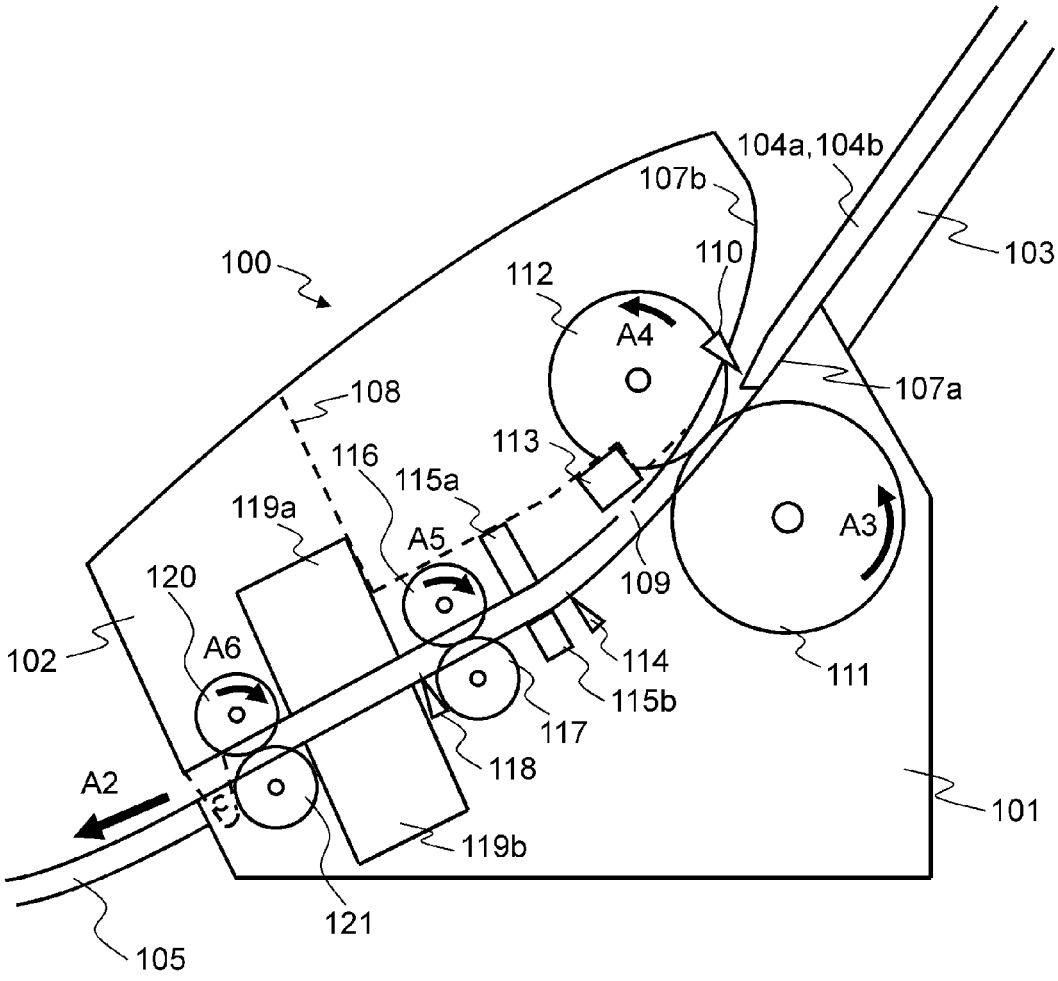
FIG. 2 is a view for explaining an example of a conveyance route at an inside of a paper conveying apparatus 100.

FIG. 2 is a view for explaining an example of the conveyance route at the inside of the paper conveying apparatus 100.

The conveyance route at the inside of the paper conveying apparatus 100 has a first paper detector 110, a paper feed roller 111, a retard roller 112, a microphone 113, a second paper detector 114, an ultrasonic transmitter 115*a*, an ultrasonic receiver 115*b*, a first conveyor roller 116, a first driven roller 117, a third paper detector 118, a first image capture unit 119*a*, a second image capture unit 119*b*, a second conveyor roller 120, a second driven roller 121, etc.

The top surface of the lower housing 101 forms the lower guide 107*a* of the conveyance path of the paper, while the bottom surface of the upper housing 102 forms the upper guide 107*b* of the conveyance path of the paper. In FIG. 2, the arrow mark A2 shows the conveyance direction of the paper. Below, "upstream" means upstream of the conveyance direction A2 of the paper, while "downstream" means downstream of the conveyance direction A2 of the paper.

The first paper detector 110 has a contact detection sensor which is arranged at an upstream side of the paper feed roller 111 and the retard roller 112 and detects if a paper is placed on the paper tray 103. The first paper detector 110 generates and outputs a first paper detection signal which changes in signal value between a state in which a paper is placed on the paper tray 103 and a state in which one is not placed.

The microphone 113 is an example of a sound detector, is provided near a conveyance path of a paper, and detects the sound generated by a paper during conveyance of the paper, and generates and outputs an analog signal corresponding to the detected sound. The microphone 113 is arranged at the downstream side of the paper feed roller 111 and the retard roller 112 while fastened to the frame 108 at the inside of the upper housing 102. A hole 109 is provided in the upper guide 107*b* facing the microphone 113, so that the sound generated by the paper during conveyance of the paper can be more accurately detected by the microphone 113.

The second paper detector 114 has a contact detection sensor which is arranged at a downstream side of the paper feed roller 111 and the retard roller 112 and at an upstream side of the first conveyor roller 116 and first driven roller 117 and detects if there is a paper present at that position. The second paper detector 114 generates and outputs a second paper detection signal which changes in signal value between a state at which there is a paper at that position and a state where there is no paper there.

The ultrasonic transmitter 115*a* and the ultrasonic receiver 115*b* are an example of an ultrasonic detector, and are arranged near the conveyance path of the paper so as to face each other across the conveyance path. The ultrasonic transmitter 115*a* transmits an ultrasonic wave. On the other hand, the ultrasonic receiver 115*b* detects an ultrasonic wave which is transmitted by the ultrasonic transmitter 115*a* and passes through the paper or papers, and generates and outputs an ultrasonic signal comprised of an electrical signal corresponding to the detected ultrasonic wave. Below, the ultrasonic transmitter 115*a* and the ultrasonic receiver 115*b* will sometimes be referred to altogether as the "ultrasonic sensor 115".

The third paper detector 118 has a contact detection sensor which is arranged at a downstream side of the first conveyor roller 116 and the first driven roller 117 and an upstream side of the first image capture unit 119*a* and the second image capture unit 119*b* and detects if there is a paper at that position. The third paper detector 118 generates and outputs a third paper detection signal which changes in signal value between a state where there is a paper at that position and a state where there is no such paper there.

The first image capture unit 119*a* has a CIS (contact image sensor) of an equal magnification optical system type which is provided with an image capture element using CMOS's (complementary metal oxide semiconductors) which are arranged in a line in the main scan direction. This CIS reads the back surface of the paper and generates and outputs an analog image signal. Similarly, the second image capture unit 119*b* has a CIS of an equal magnification optical system type which is provided with an image capture element using CMOS's which are arranged in a line in the main scan direction. This CIS reads the front surface of the paper and generates and outputs an analog image signal. Note that, it is also possible to arrange only one of the first image capture unit 119*a* and the second image capture unit 119*b* and read only one surface of the paper. Further, instead of a CIS, it is also possible to utilize an image capturing sensor of a reduced magnification optical system type using CCD's (charge coupled devices). Below, the first image capture unit 119*a* and the second image capture unit 119*b* will sometimes be referred to overall as the "image capture units 119".

A paper which is placed on the paper tray 103 is conveyed between the lower guide 107*a* and the upper guide 107*b* toward the paper conveyance direction A2 by rotation of the paper feed roller 111 in the direction of the arrow mark A3 of FIG. 2. The retard roller 112 rotates in the direction of the arrow mark A4 of FIG. 2 at the time of paper conveyance. Due to the action of the paper feed roller 111 and the retard roller 112, when the paper tray 103 has a plurality of papers placed on it, among the papers which are placed on the paper tray 103, only the paper which is in contact with the paper feed roller 111 is separated. The conveyance of papers other than the separated paper is restricted (prevention of multifeed). The paper feed roller 111 and the retard roller 112 function as a paper separator.

A paper is fed between the first conveyor roller 116 and the first driven roller 117 while being guided by the lower guide 107*a* and the upper guide 107*b*. The paper is sent between the first image capture unit 119*a* and the second image capture unit 119*b* by the first conveyor roller 116 rotating in the direction of the arrow mark A5 of FIG. 2. The paper which is read by the image capture unit 119 is ejected onto the ejection tray 105 by the second conveyor roller 120 rotating in the direction of the arrow mark A6 of the FIG. 2.

Figure 3:
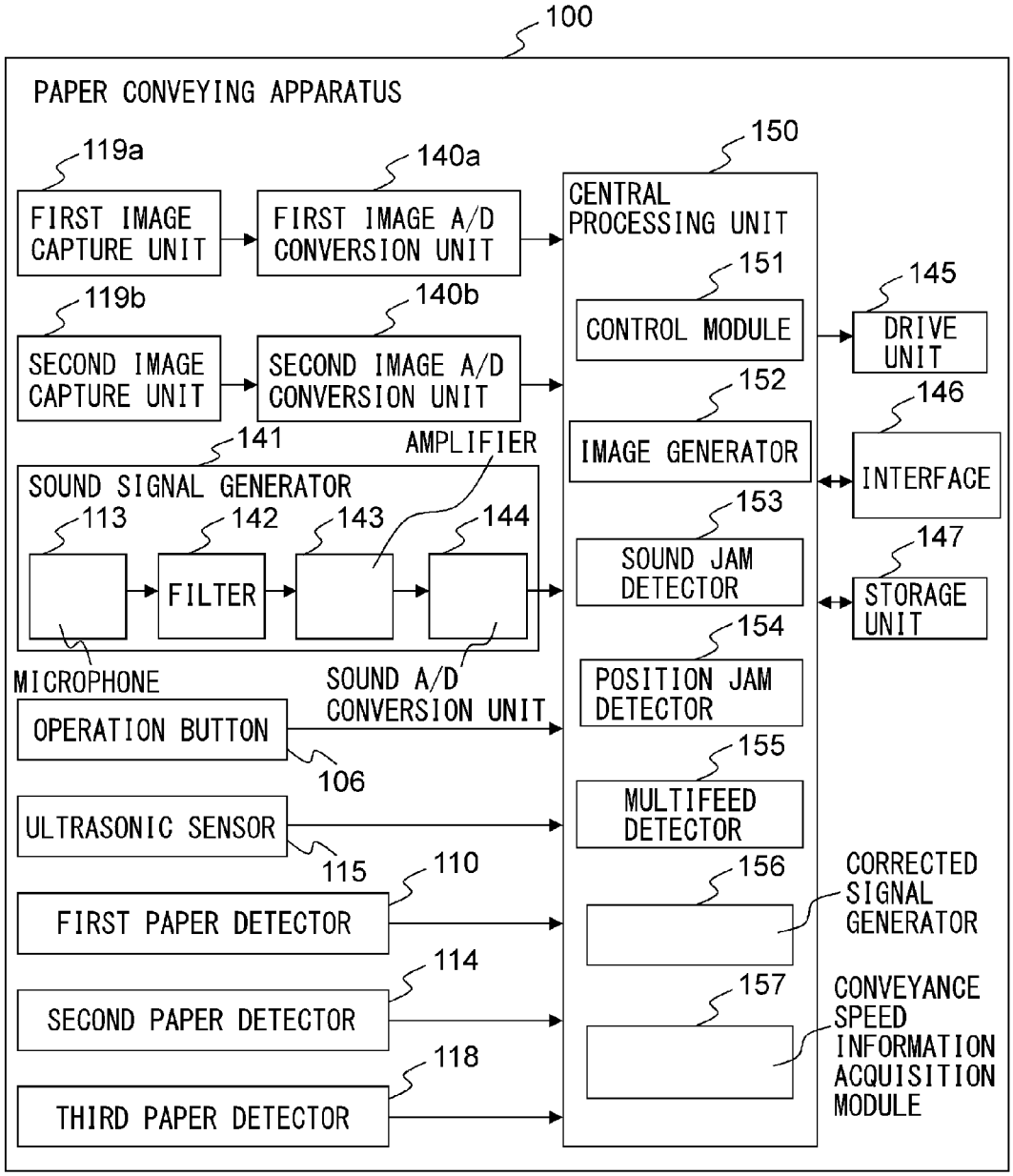
FIG. 3 is an example of a block diagram which shows a schematic configuration of a paper conveying apparatus 100.

FIG. 3 is an example of a block diagram which shows the general configuration of a paper conveying apparatus 100.

The paper conveying apparatus 100, in addition to the above-mentioned configuration, further has a first image A/D conversion unit 140*a*, a second image A/D conversion unit 140*b*, a sound signal generator 141, a drive unit 145, an interface 146, a storage unit 147, a central processing unit 150, etc.

The first image A/D conversion unit 140*a* converts an analog image signal which is output from the first image capture unit 119*a* from an analog to digital format to generate digital image data which it then outputs to the central processing unit 150. Similarly, the second image A/D conversion unit 140*b* converts the analog image signal which is output from the second image capture unit 119*b* from an analog to digital format to generate digital image data which it then outputs to the central processing unit 150. Below, these digital image data will be referred to as the "read image".

The sound signal generator 141 includes a microphone 113, a filter 142, an amplifier 143, a sound A/D conversion unit 144, etc., and generates a sound signal. The filter 142 applies a bandpass filter which passes a predetermined frequency band of a signal to an analog signal which is output from the microphone 113 and outputs it to the amplifier 143. The amplifier 143 amplifies the signal which is output from the filter 142 and outputs it to the sound A/D conversion unit 144. The sound A/D conversion unit 144 samples the analog signal which is output from the amplifier 143 at predetermined sampling rate to convert it to a digital format and generates a digital signal and outputs it to the central processing unit 150. Below, a signal which is output by the sound signal generator 141 will be referred to as a "sound signal".

Note that, the sound signal generator 141 is not limited to this. The sound signal generator 141 may include only the microphone 113, while the filter 142, the amplifier 143, and the sound A/D conversion unit 144 may be provided outside of the sound signal generator 141. Further, the sound signal generator 141 may include only the microphone 113 and the filter 142 or only the microphone 113, the filter 142, and the amplifier 143.

The drive unit 145 includes one or more motors and uses control signals from the central processing unit 150 to rotate the paper feed roller 111, the retard roller 112, the first conveyor roller 116, and the second conveyor roller 120 and operate to convey a paper.

The interface 146 has, for example, a USB or other serial bus-based interface circuit and electrically connects with the information processing apparatus 10 to send and receive a read image and various types of information. Further, it is also possible to connect a flash memory etc., to the interface 146 so as to store the read image.

The storage unit 147 has a RAM (random access memory), ROM (read only memory), or other memory device, a hard disk or other fixed disk device, or flexible disk, optical disk, or other portable storage device. Further, the storage unit 147 stores a computer program, database, tables, etc., which are used in various processing of the paper conveying apparatus 100. The computer program may be installed on the storage unit 147 from a computer-readable, non-transitory medium such as a compact disk read only memory (CD-ROM), a digital versatile disk read only memory (DVD-ROM), or the like by using a well-known setup program or the like. Furthermore, the storage unit 147 stores the read images and scanning information input by a user. The scanning information includes resolution information for scanning a paper.

The central processing unit 150 is provided with a CPU (central processing unit) and operates based on a program which is stored in advance in the storage unit 147. Note that, the central processing unit 150 may also be comprised of a DSP (digital signal processor), LSI (large scale integrated circuit), ASIC (application specific integrated circuit), FPGA (field-programming gate array), etc.

The central processing unit 150 is connected to the operation button 106, first paper detector 110, second paper detector 114, ultrasonic sensor 115, third paper detector 118, first image capture unit 119*a*, second image capture unit 119*b*, first image A/D conversion unit 140*a*, second image A/D conversion unit 140*b*, sound signal generator 141, drive unit 145, interface 146, and storage unit 147 and controls these units.

The central processing unit 150 control a drive operation of the drive unit 145, control a paper read operation of the image capture unit 119, etc., to acquire a read image. Further, the central processing unit 150 has a control module 151, an image generator 152, a sound jam detector 153, a position jam detector 154, a multifeed detector 155, a corrected signal generator 156, a conveyance speed information acquisition module 157, etc. These units are functional modules which are realized by software which operate on a processor. Note that, these units may be comprised of respectively independent integrated circuits, a microprocessor, firmware, etc.

Figure 4:
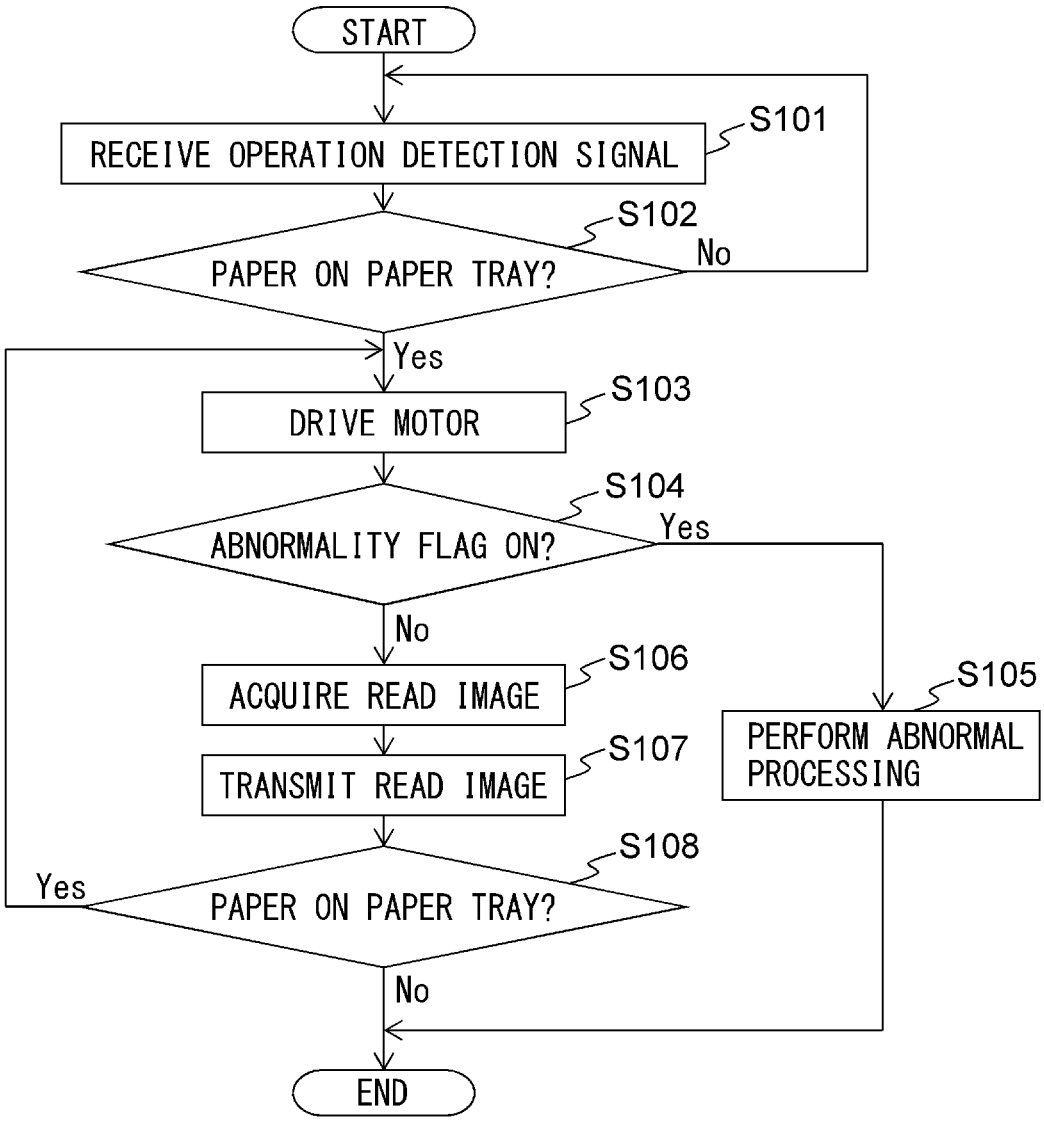
FIG. 4 is a flow chart which shows an example of operation of overall processing of a paper conveying apparatus 100.

FIG. 4 is a flow chart which shows an example of operation of overall processing of the paper conveying apparatus 100.

Below, referring to the flow chart which is shown in FIG. 4, an example of the operation of the overall processing of the paper conveying apparatus 100 will be explained. Note that, the flow of the operation which is explained below is performed based on a program which is stored in advance in the storage unit 147 mainly by the central processing unit 150 in cooperation with the elements of the paper conveying apparatus 100.

First, the central processing unit 150 stands by until a user pushes the operation button 106 and an operation detection signal is received from the operation button 106 (step S101).

Next, the central processing unit 150 determines whether the paper tray 103 has a paper placed on it based on the first paper detection signal which was received from the first paper detector 110 (step S102).

If the paper tray 103 does not have a paper placed on it, the central processing unit 150 returns the processing to step S101 and stands by until newly receiving an operation detection signal from the operation button 106.

On the other hand, when the paper tray 103 has a paper placed on it, the central processing unit 150 drives the drive unit 145 to rotate the paper feed roller 111, retard roller 112, first conveyor roller 116, and second conveyor roller 121 and convey the paper (step S103).

Next, the control module 151 determines whether an abnormality flag is ON or not (step S104). This abnormality flag is set OFF at the time of startup of the paper conveying apparatus 100 and is set ON if a later explained abnormality detection processing determines that an abnormality has occurred.

When the abnormality flag is ON, the control module 151, as an abnormal processing, stops the drive unit 145 to stop the conveyance of the paper, uses a not shown speaker, LED (light emitting diode), etc. to notify the user of the occurrence of an abnormality, sets the abnormality flag OFF (step S105), and ends the series of steps.

On the other hand, when the abnormality flag is not ON, the image generator 152 makes the first image capture unit 119*a* and the second image capture unit 119*b* read the conveyed paper and acquires the read image through the first image A/D conversion unit 140*a* and the second image A/D conversion unit 140*b* (step S106).

Next, the central processing unit 150 transmits the acquired read image through the interface 146 to a not shown information processing apparatus (step S107). Note that, when not connected to an information processing apparatus, the central processing unit 150 stores the acquired read image in the storage unit 147.

Next, the central processing unit 150 determine whether the paper tray 103 has a paper remaining thereon based on the first paper detection signal which was received from the first paper detector 110 (step S108).

When the paper tray 103 has a paper remaining thereon, the central processing unit 150 returns the processing to step S103 and repeats the processing of steps S103 to S108. On the other hand, when the paper tray 103 does not have any paper remaining thereon, the central processing unit 150 ends the series of processing.

Figure 5:
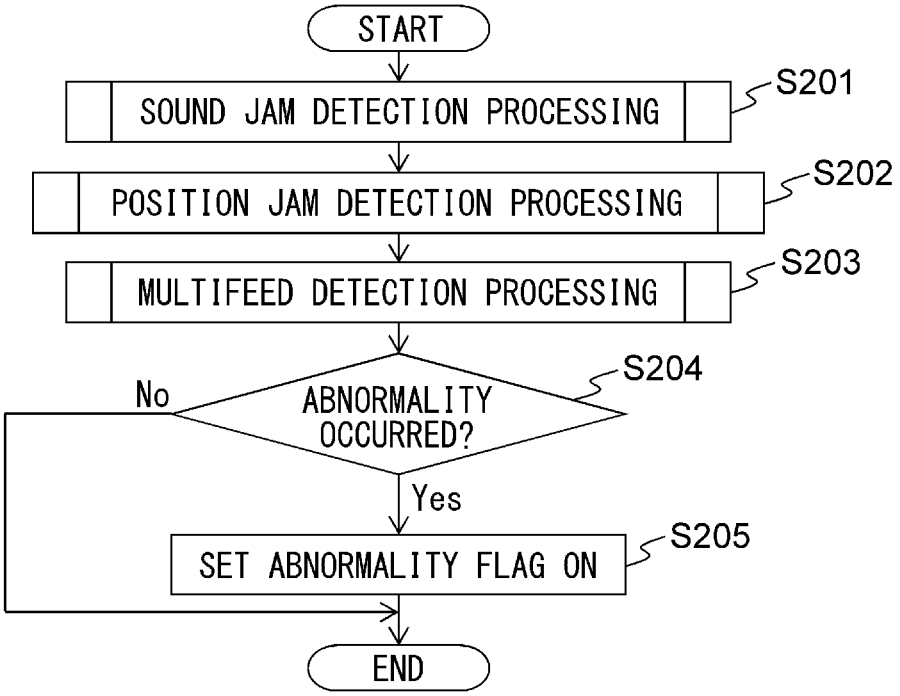
FIG. 5 is a flow chart which shows an example of an abnormality detection of the paper conveyance.

FIG. 5 is a flow chart which shows an example of an abnormality detection of the paper conveyance of the paper conveying apparatus 100.

The flow of operation which is explained below is executed based on a program which is stored in advance in the storage unit 147 mainly by the central processing unit 150 in cooperation with the elements of the paper conveying apparatus 100.

First, the sound jam detector 153 executes sound jam detection processing (step S201). In the sound jam detection processing, the sound jam detector 153 determines whether a jam has occurred based on the sound signal which was acquired from the sound signal generator 141. Below, sometimes a jam which is determined to exist by the sound jam detector 153 based on a sound signal will be called a "sound jam". Details of the sound jam detection processing will be explained later.

Next, the position jam detector 154 performs position jam detection processing (step S202). In the position jam detection processing, the position jam detector 154 determines the occurrence of a jam based on the second paper detection signal which is acquired from the second paper detector 114 and the third paper detection signal which is acquired from the third paper detector 118. Below, sometimes a jam which is determined to exist by the position jam detector 154 based on the second paper detection signal and third paper detection signal will be called a "position jam". Details of the position jam detection processing will be explained later.

Next, the multifeed detector 155 performs multifeed detection processing (step S203). In the multifeed detection processing, the multifeed detector 155 determines the occurrence of a multifeed of papers based on the ultrasonic signal which was acquired from the ultrasonic sensor 116. Details of the multifeed detection processing will be explained later.

Next, the control module 151 determines whether an abnormality has occurred in the paper conveyance processing (step S204). The control module 151 determines that an abnormality has occurred if at least one of a sound jam, position jam, and paper multifeed has occurred. That is, it is determined that no abnormality has occurred when none of a sound jam, position jam, or paper multifeed has occurred.

The control module 151 sets the abnormality flag to ON (step S205) and ends the series of steps when an abnormality occurs in the paper conveyance processing. On the other hand, when no abnormality occurs in the paper conveyance processing, it ends the series of steps without particularly performing any further processing. Note that, the flow chart which is shown in FIG. 5 is repeatedly executed every predetermined time interval.

Figure 6:
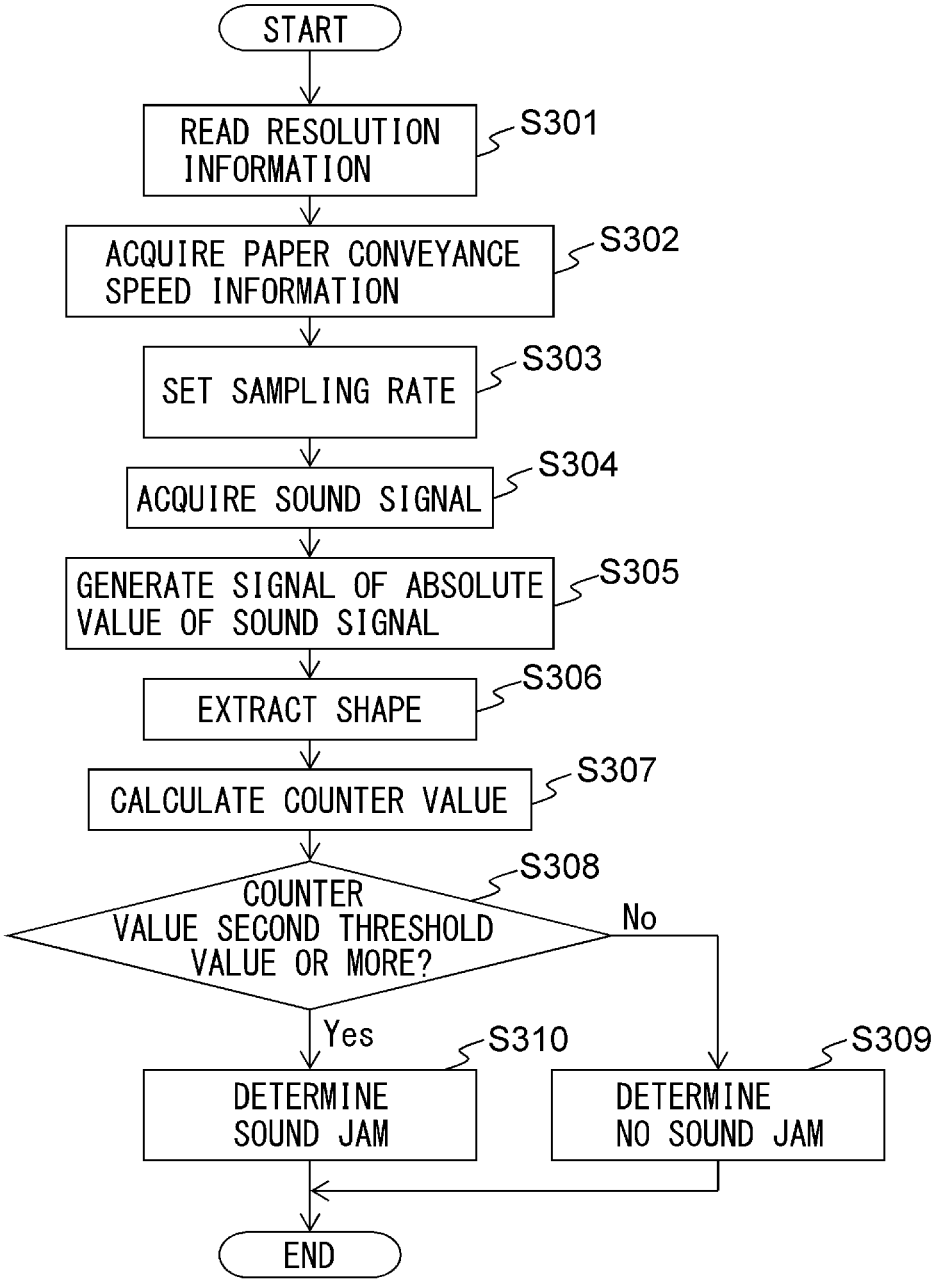
FIG. 6 is a flow chart which shows an example of operation of sound jam judgment processing.

FIG. 6 is a flow chart which shows an example of operation of a sound jam judgment processing.

The flow of operation which is shown in FIG. 6 is executed at step S201 of the flow chart which is shown in FIG. 5.

First, the conveyance speed information acquisition module 157 reads out the resolution information in the scanning information from the storage unit 147 (step S301). Note that, the scanning information is set from the image processing apparatus 10 through the interface 146.

Figure 7:
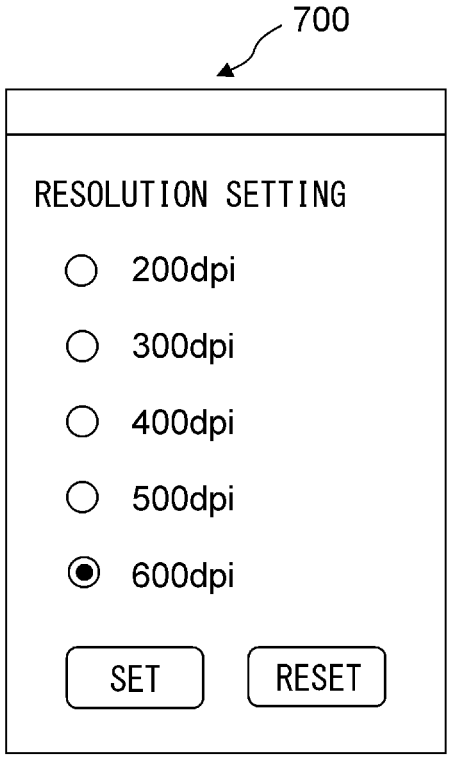
FIG. 7 is a view which shows an example of a settings screen 700 for a resolution for reading a paper.

FIG. 7 shows an example of the settings screen 700 which the image processing apparatus 10 displays for setting the resolution for reading a paper.

As shown in FIG. 7, the settings screen 700 displays selection buttons for a user to select the resolution for reading a paper. If the resolution is selected by the user and the set button is pushed, the image processing apparatus 10 transmits resolution information which shows the selected resolution to the paper conveying apparatus 100. If the interface 146 of the paper conveying apparatus 100 receives the resolution information from the image processing apparatus 10, it transmits the received resolution information to the central processing unit 150. The central processing unit 150 stores the resolution information which is received from the interface 145 as scanning information in the storage unit 147 and sets the rotational speed of the drive unit 145 in accordance with the resolution information to set the conveyance speed of the paper. The conveyance speed is set so as to become faster the smaller the resolution and to become slower the larger the resolution. For example, when the resolution is 200 dpi (dots per inch), the conveyance speed is set to 60 ppm (pages per minute) and when the resolution is 600 dpi, the conveyance speed is set to 15 ppm.

Next, the conveyance speed information acquisition module 157 acquires conveyance speed information which shows the conveyance speed of the paper which was set by the central processing unit 150 based on the read resolution information (step S302).

Next, the corrected signal generator 156 sets the sampling rate for the sound A/D conversion unit 144 to convert the analog signal to the digital signal in accordance with the conveyance speed information which the conveyance speed information acquisition module 157 acquired (step S303).

That is, the corrected signal generator 156 sets a method of correcting the sound signal in accordance with the conveyance speed information. The sampling rate is set higher the faster the conveyance speed and lower the slower the conveyance speed so that the ratio of the sampling rate to the conveyance speed becomes substantially constant (for example, 1.6 kHz/ppm). For example, when the conveyance speed is 60 ppm, the sampling rate is set to 96 kHz, while when the conveyance speed is 15 ppm, the sampling rate is set to 24 kHz. Note that, the sampling rate is set in a range where the peak sound of the sound which is generated due to a jam can be detected.

Next, the corrected signal generator 156 acquires the sound signal from the sound signal generator 141 (step S304).

Figure 8A:
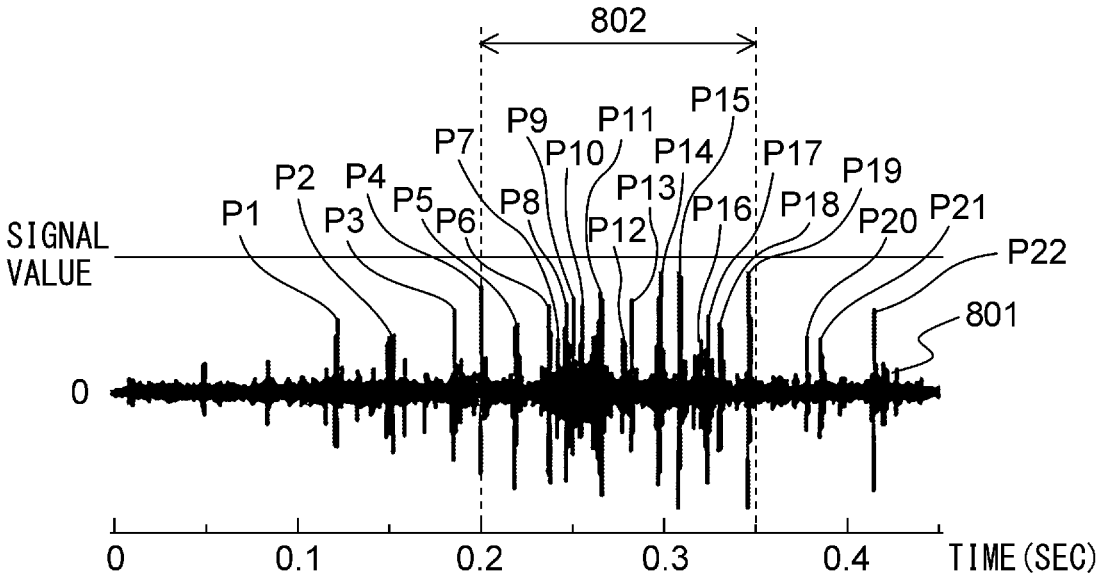
FIG. 8A is a graph which shows an example of a sound signal when a jam occurs.

FIG. 8A is a graph which shows an example of a sound signal in the case where a jam has occurred.

In FIG. 8A, the abscissa shows the time, while the ordinate shows the signal value of the sound signal. The signal 801 of FIG. 8A shows the digital sound signal which is acquired from the sound A/D conversion unit 144 when a paper is conveyed by a high speed (60 ppm) and the sampling rate is set to 96 kHz.

Next, the corrected signal generator 156 generates a signal of the absolute value for the sound signal which is acquired from the sound A/D conversion unit 144 (step S305).

Next, the corrected signal generator 156 extracts the shape of the signal of the absolute value of the sound signal (step S306). Below, the extracted shape will sometimes be referred to as "the corrected signal". The corrected signal generator 156 acquires as a corrected signal for the signal of the absolute value of the sound signal a signal which makes the peak value attenuate by a predetermined attenuation rate every sampling interval (below, referred to as the "peak attenuation signal"). The predetermined attenuation rate can be made, for example, $\{(2^{10}-1)/(2^{10})\}=0.999023$.

Figure 8B:
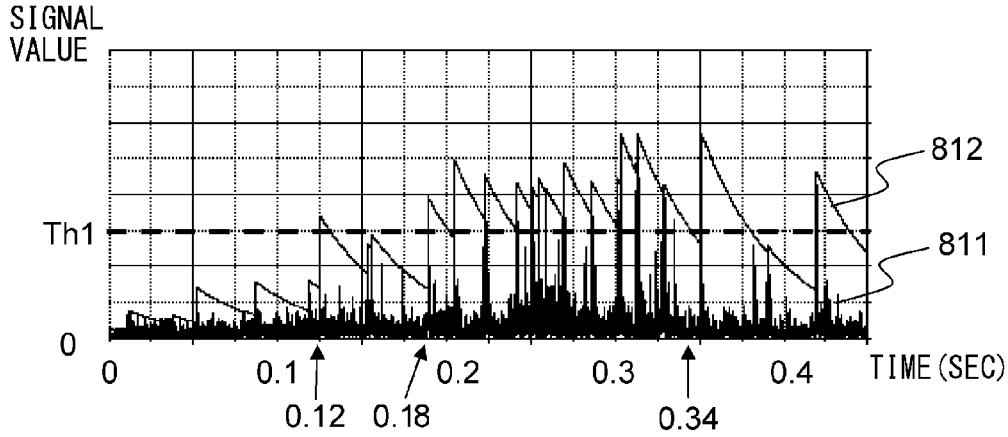
FIG. 8B is a graph which shows an example of a corrected signal.

FIG. 8B is a graph which shows an example of the corrected signal.

In FIG. 8B, the abscissa shows the time, while the ordinate shows the signal value of the sound signal. In FIG. 8B, the signal 811 shows the signal of the absolute value of the sound signal 801 of FIG. 8A, while the signal 812 shows the peak attenuation signal which is extracted as the corrected signal of the signal 811.

Next, the sound jam detector 153 calculates a counter value which it makes increase when the signal value of the corrected signal is the first threshold value Th1 or more and it makes decrease when it is less than the first threshold value Th1 (step S307). The sound jam detector 153 determines whether the value of the peak attenuation signal is the first threshold value Th1 or more at every sampling interval of the sound signal, increments the counter value when the value of the peak attenuation signal is first threshold value Th1 or more, and decrements the counter value when it is less than the first threshold value Th1.

Figure 8C:
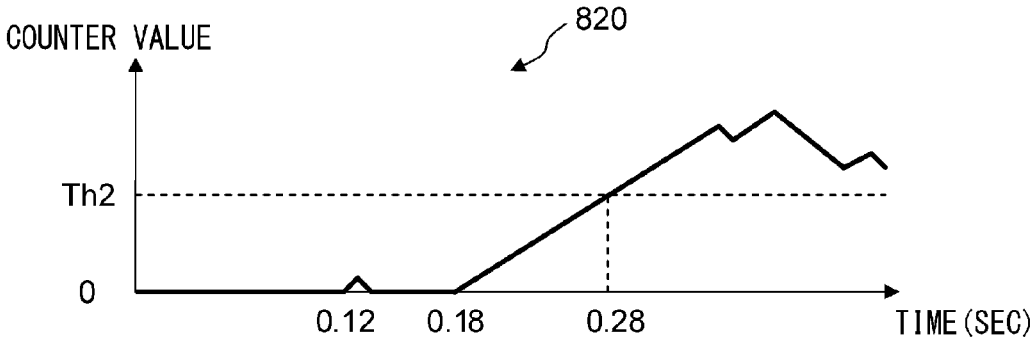
FIG. 8C is a graph which shows an example of a counter value.

FIG. 8C is a graph which shows an example of the counter value which is calculated for the corrected signal.

In FIG. 8C, the abscissa shows the time, while the ordinate shows the counter value. In FIG. 8C, the graph 820 shows the counter value which is calculated for the peak attenuation signal 812 of FIG. 8B.

Next, the sound jam detector 153 determines whether the counter value is the second threshold value Th2 or more (step S308). The sound jam detector 153 determines that a sound jam has occurred if the counter value is the second threshold value Th2 or more (step S309), determines that a sound jam has not occurred if the counter value is less than the second threshold value Th2 (step S310), and ends the series of steps.

In FIG. 8B, the peak attenuation signal 812 becomes the first threshold value Th1 or more at the time 0.12 second, becomes less than the first threshold value Th1 after that, again becomes the first threshold value Th1 or more at the time 0.18 second, and does not become less than the first threshold value Th1 after that until the time 0.34 second. For this reason, as shown in FIG. 8C, the counter value increases from the time 0.12 second, decreases once, again increases from the time 0.18 second, and becomes the second threshold value Th2 or more at the time 0.28 second, whereby the sound jam detector 153 determines that a sound jam has occurred.

Figure 9A:
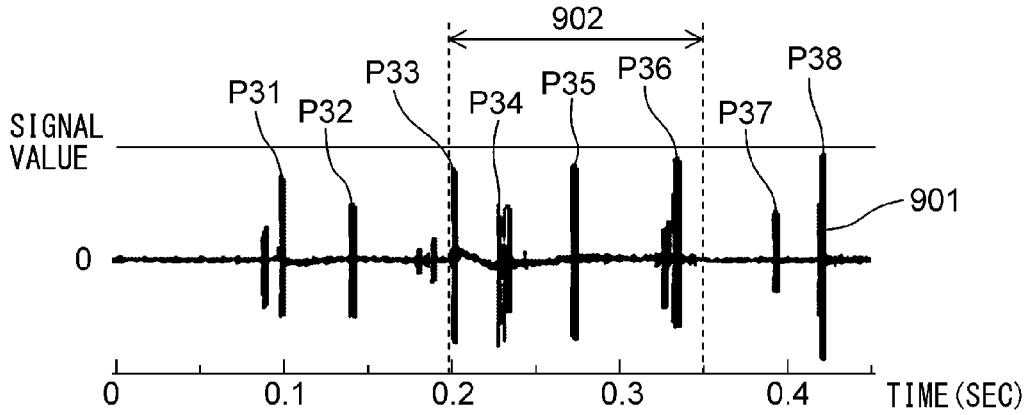
FIG. 9A is a graph which shows an example of another sound signal in the case where a jam occurs.
Figure 9B:
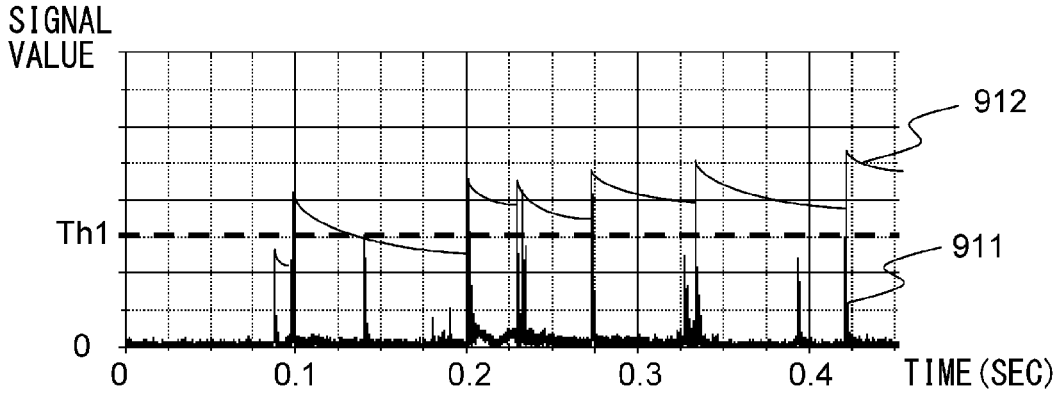
FIG. 9B is a graph which shows an example of a corrected signal.
Figure 9C:
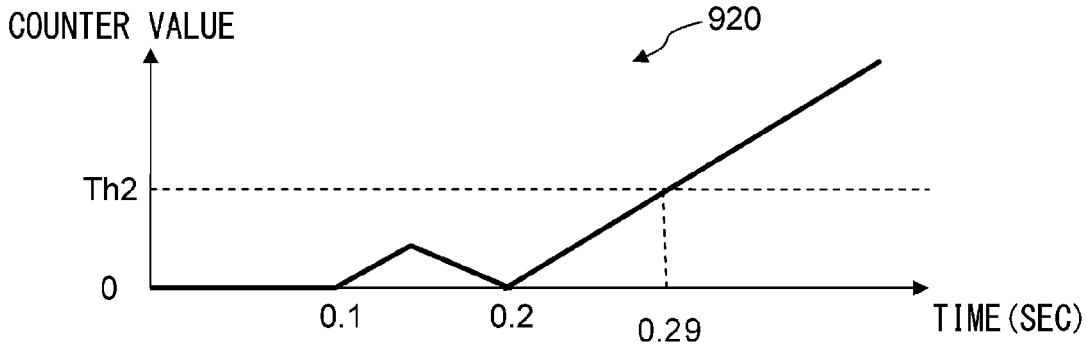
FIG. 9C is a graph which shows an example of a counter value.

FIG. 9A, FIG. 9B, and FIG. 9C are graphs which show examples of other sound signals in the case where a jam has occurred and signals which are generated from those sound signals.

In FIG. 9A, FIG. 9B, and FIG. 9C, the abscissas show the time, in FIG. 9A and FIG. 9B, the ordinates show the signal value of the sound signal, and in FIG. 9C, the ordinate shows the counter value. The signal 901 of FIG. 9A shows a digital sound signal in the case where a paper is conveyed at a slow speed (16 ppm) and the sampling rate is set to 24 kHz. The signal 911 of FIG. 9B shows the signal of the absolute value of the sound signal 901 of FIG. 9A, while the signal 912 shows the peak attenuation signal which is extracted as the corrected signal of the signal 911. The graph 920 of FIG. 9C shows the counter value which is calculated for the peak attenuation signal 912 of FIG. 9B.

The sound signal 901 of FIG. 9A shows a sound signal of 0.45 second duration in the same way as the sound signal 801 of FIG. 8A, but the sampling rate of the sound signal 901 is ¼ of the sampling rate of the sound signal 801, so the number of samples of the sound signal 901 becomes ¼ of the number of samples of the sound signal 801.

In FIG. 9B, the peak attenuation signal 912 becomes the first threshold value Th1 or more at the time 0.1 second, becomes less than the first threshold value Th1 after that, again becomes the first threshold value Th1 or more at the time 0.2 second, and does not become less than the first threshold value Th1 after that. For this reason, as shown in FIG. 9C, the counter value increases from the time 0.1 second, decreases once, increases again from the time 0.2 second, and becomes the second threshold value Th2 or more at the time 0.29 second, whereby the sound jam detector 153 determines that a sound jam has occurred.

Below, the reason for setting the sampling rate in accordance with the conveyance speed information will be explained.

The sound which is generated by a jam is generated due to deformation of the paper. If a paper being conveyed starts to deform, the more that paper moves, the greater the degree of deformation will become. A large sound will be generated each time a paper is deformed. For this reason, when a jam occurs, the timing at which a large sound is generated due to a jam tends to be synchronized with the timing at which the paper moves by a predetermined distance. On the other hand, the time during which the paper moves over a predetermined is inversely proportional to the conveyance speed of the paper. For this reason, the time period at which a large sound is generated due to a jam tends to become shorter in inverse proportion to the conveyance speed of the paper.

In the sound signal 801 in the case where the paper is conveyed at 60 ppm shown in FIG. 8A, peak values P1 to P22 appear along with movement of the paper in a jammed state. On the other hand, in the sound signal 901 as shown in FIG. 9A in the case where the paper is conveyed by 16 ppm, the peak values P31 to P38 appear along with movement of the paper in the jam state. In the sound signal 801, the number of peak values in the section 802 of 0.15 second duration where peak values particularly concentrate is the 16 peak values P4 to P19. On the other hand, in the sound signal 901, the number of peak values in the section 902 of 0.15 second duration where peak values particularly concentrate is the four peak values P33 to P36. That is, the interval between the timings where the peak values appear in the section 802 is about ¼ of the interval between the timings where the peak values appear in the section 902. On the other hand, the conveyance speed for the sound signal 801 is about four times the conveyance speed for the sound signal 901, so the intervals between the timings where the peak values appear in the section 802 and the section 902 are approximately inversely proportional to the conveyance speed of the paper.

In the corrected signal generator 156, the sampling rate is set so that the ratio of the sampling rate to the conveyance speed of the paper becomes substantially constant (for example, 1.6 kHz/ppm). Therefore, in a sound signal, the number of samples between the timings at which peak values appear can be made substantially constant regardless of the conveyance speed of the paper.

The corrected signal is a signal which is acquired by attenuating the peak value by a predetermined attenuation rate every sampling interval. By making the number of samples between the timings at which peak values appear in a sound signal substantially constant, it is possible to make the amount by which a signal value attenuates from when a peak value appears in the corrected signal to when the next peak value appears substantially constant. The corrected signal generator 156 generates the corrected signal so that the shape of the signal does not change by the conveyance speed of the paper. The sound jam detector 153 determines whether a sound jam has occurred based on the corrected signal without changing the content of the detection processing due to the conveyance speed of the paper.

Figure 10A:
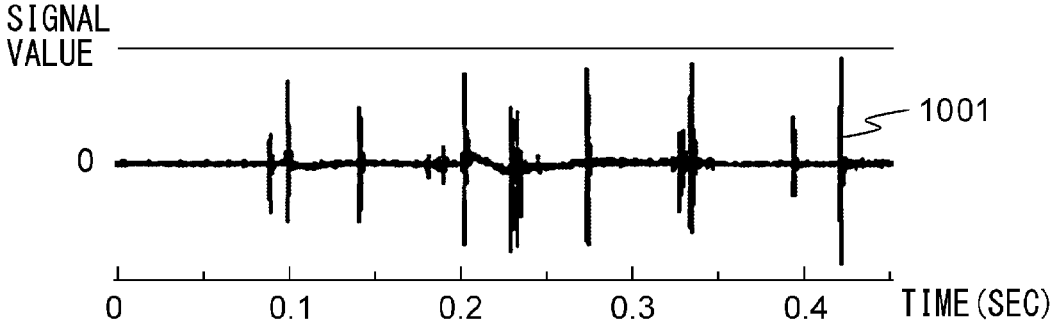
FIG. 10A is a graph which shows an example of still another sound signal in the case where a jam occurs.
Figure 10B:
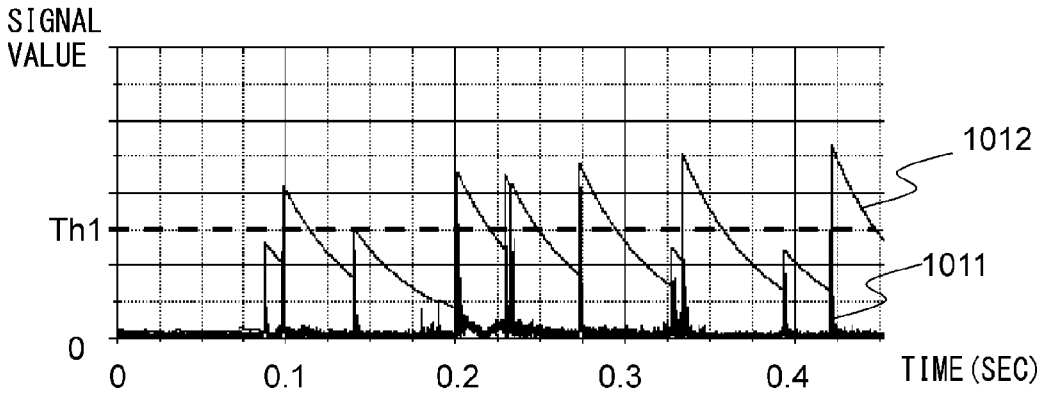
FIG. 10B is a graph which shows an example of a corrected signal.
Figure 10C:
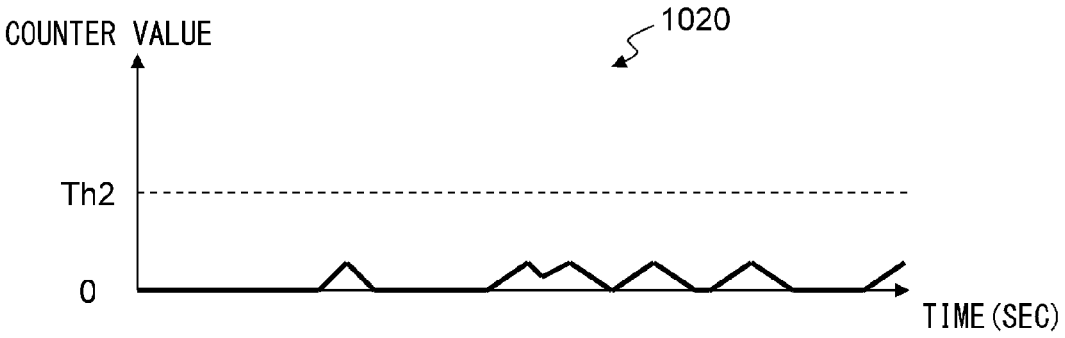
FIG. 10C is a graph which shows an example of a counter value.

FIG. 10A, FIG. 10B, and FIG. 10C are graphs which show examples of still another sound signal in the case where a jam has occurred and signals which are generated from the sound signal.

In FIG. 10A, FIG. 10B, and FIG. 10C, the abscissas show the time, in FIG. 10A and FIG. 10B, the ordinates show the signal value of the sound signal, and in FIG. 10C, the ordinate shows the counter value. The sound signal 1001 of FIG. 10A shows an example, for comparison with the sound signal 901 of FIG. 9A, of utilization of a sampling rate (96 kHz) the same as the case where the conveyance speed is a high speed (60 ppm) in the case where the conveyance speed is a low speed (16 ppm). The signal 1011 of FIG. 10B shows a signal of the absolute value of the sound signal 1001 of FIG. 10A, while the signal 1012 shows the peak attenuation signal which is extracted as the corrected signal of the signal 1011. The graph 1020 of FIG. 10C shows the counter value which is calculated for the peak attenuation signal 1012 of FIG. 10B.

The sound signal 1001 of FIG. 10A shows a sound signal of 0.45 second duration the same as the sound signal 901 of FIG. 9A. However, the sampling rate of the sound signal 1001 is four times the sampling rate of the sound signal 901, so the number of samples of the sound signal 1001 becomes four times the number of samples of the sound signal 901.

In the peak attenuation signal 1012 of FIG. 10B, compared with the peak attenuation signal 912 of FIG. 9B, the number of samples from when a peak value appears to when the next peak value appears is large, so the signal value overly attenuates. The peak attenuation signal 1012 repeatedly becomes the first threshold value Th1 or more and less than the first threshold value Th1. As shown in FIG. 10C, the counter value repeatedly increases and decreases. It does not become the second threshold value Th2 or more, so it is not determined that a sound jam has occurred.

As illustrated in FIG. 10A to FIG. 10C, if utilizing a sampling rate the same as the case where the conveyance speed is a high speed when the conveyance speed is a low speed, in the peak attenuation signal, the number of samples between the peak values becomes greater, the signal value attenuates too much, and there is a possibility of mistaken detection. For this reason, it may be considered to set the first threshold value Th1, the second threshold value Th2, and other parameters in the sound jam detector 153 so as to use the optimal values in accordance with the conveyance speed so as to determine a sound jam. However, if changing the first threshold value Th1, the second threshold value Th2, and other parameters, the signal value due to the conveyance sound of a paper, sound generated outside the apparatus, and other sound smaller than the sound generated due to a jam will become the first threshold value Th1 or more, the counter value will become the second threshold value Th2 due to a sound much shorter in duration of generation, and there is a possibility of mistaken detection that a jam has occurred. For this reason, it is not easy to set the first threshold value Th1, the second threshold value Th2, and other parameters so as to uniformly change in accordance with the conveyance speed of the paper.

On the other hand, as explained above, if setting the sampling rate in accordance with the conveyance speed, the amount of attenuation between the peak values will change in the peak attenuation signal, but there will be little possibility of mistaken detection that a jam has occurred due to a sound smaller than the sound generated due to a jam or a sound much shorter in duration of generation. Therefore, in the sound jam detector 153 of the present application, the sampling rate is set in accordance with the conveyance speed of the paper and it is made possible to precisely determine any occurrence of a jam regardless of the conveyance speed of the paper.

Figure 11:
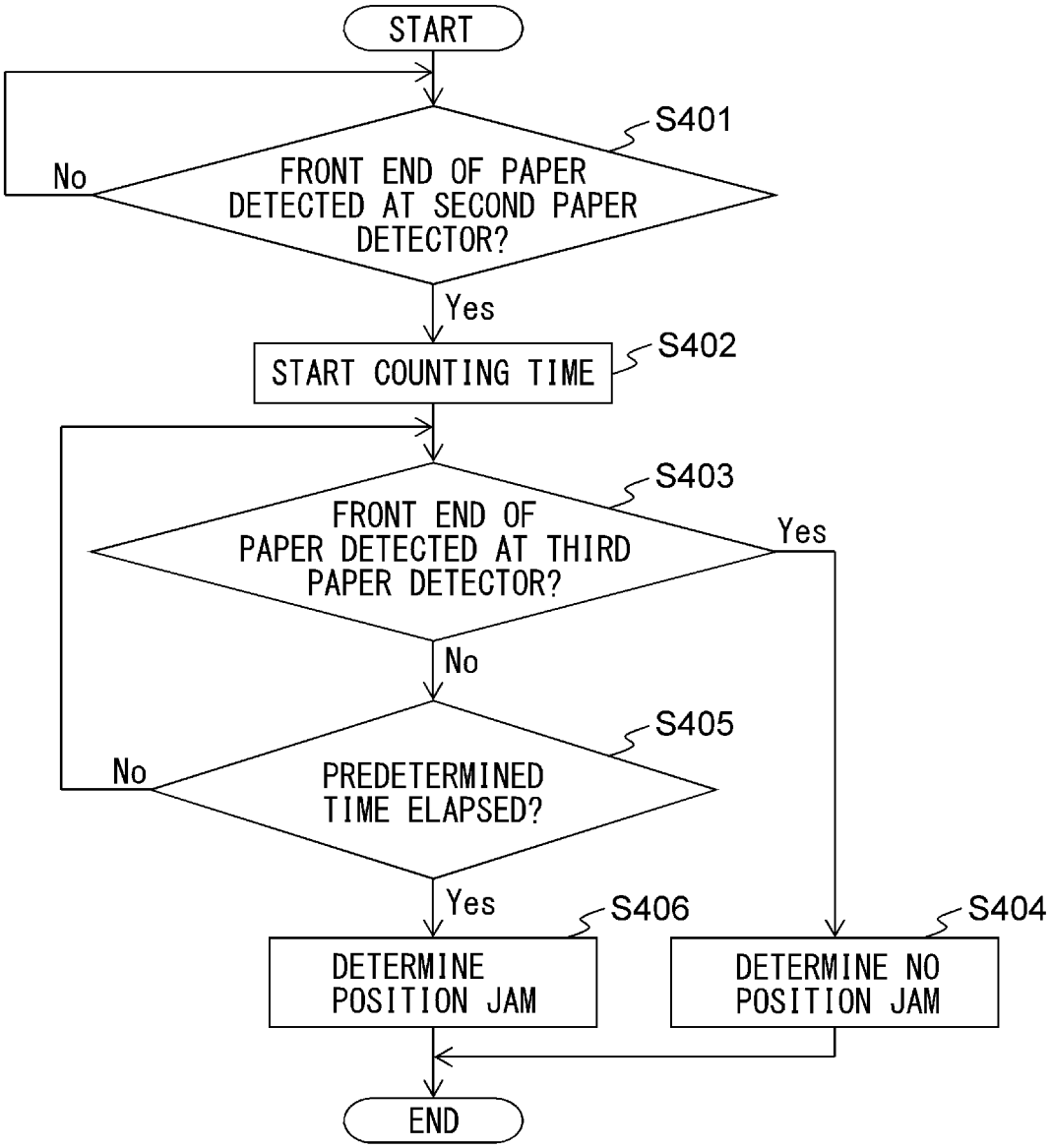
FIG. 11 is a flow chart which shows an example of operation of position jam detection processing.

FIG. 11 is a flow chart which shows an example of operation of a position jam detection processing.

The flow of operation which is shown in FIG. 11 is executed at step S202 of the flow chart which is shown in FIG. 5.

First, the position jam detector 154 stands by until the front end of the paper is detected by the second paper detector 114 (step S401). The position jam detector 154 determines that the front end of the paper is detected at the position of the second paper detector 114, that is, downstream of the paper feed roller 111 and retard roller 112 and upstream of the first conveyor roller 116 and first driven roller 117, when the value of the second paper detection signal from the second paper detector 114 changes from a value which shows the state where there is no paper to a value which shows the state where there is one.

Next, when the second paper detector 114 detects the front end of a paper, the position jam detector 154 starts counting time (step S402).

Next, the position jam detector 154 determines whether the third paper detector 118 has detected the front end of the paper (step S403). The position jam detector 154 determines that the front end of the paper is detected at the position of the third paper detector 118, that is, downstream of the first conveyor roller 116 and first driven roller 117 and upstream of the image capture unit 119, when the value of the third paper detection signal from the third paper detector 118 changes from a value which shows the state where there is no paper to a value which shows the state where there is one.

When the third paper detector 118 detects the front end of a paper, the position jam detector 154 determines that no position jam has occurred (step S404) and ends the series of steps.

On the other hand, if the third paper detector 118 detects the front end of the paper, the position jam detector 154 determines whether a predetermined time (for example, 1 second) has elapsed from the start of counting time (step S405). If a predetermined time has not elapsed, the position jam detector 154 returns to the processing of step S403 and again determines whether the third paper detector 118 has detected the front end of the paper. On the other hand, when a predetermined time has elapsed, the position jam detector 154 determines that position jam has occurred (step S406) and ends the series of steps. Note that, when position jam detection processing is not required in the paper conveying apparatus 100, this may be omitted.

Note that, when the central processing unit 150 detects that the front end of a paper is downstream of the first conveyor roller 116 and the first driven roller 117 by the third paper detection signal from the third paper detector 118, it controls the drive unit 145 to stop the rotation of the paper feed roller 111 and retard roller 112 so that the next paper is not fed. After that, when the central processing unit 150 detects the rear end of the paper downstream of the paper feed roller 111 and the retard roller 112 by the second paper detection signal from the second paper detector 114, it again controls the drive unit 145 to rotate the paper feed roller 111 and retard roller 112 and convey the next paper. Due to this, the central processing unit 150 prevents a plurality of papers from being superposed in the conveyance path. For this reason, the position jam detector 154 may start counting the time at the point of time when the central processing unit 150 controls the drive unit 145 to rotate the paper feed roller 111 and the retard roller 112 and determine that a position jam has occurred when the third paper detector 118 does not detect the front end of a paper within a predetermined time.

Figure 12:
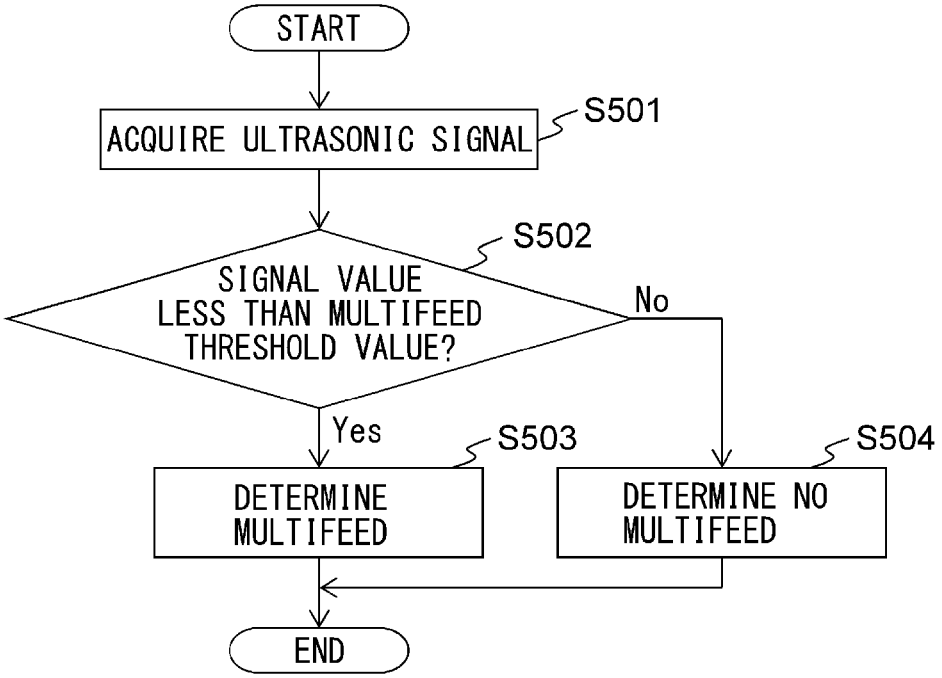
FIG. 12 is a flow chart which shows an example of operation of multifeed detection processing.

FIG. 12 is a flow chart which shows an example of operation of multifeed detection processing.

The flow of operation which is shown in FIG. 12 is executed at step S203 of the flow chart which is shown in FIG. 5.

First, the multifeed detector 155 acquires an ultrasonic signal from the ultrasonic sensor 115 (step S501).

Next, the multifeed detector 155 determines whether the signal value of the acquired ultrasonic signal is less than the multifeed detection threshold value (step S502).

Figure 13:
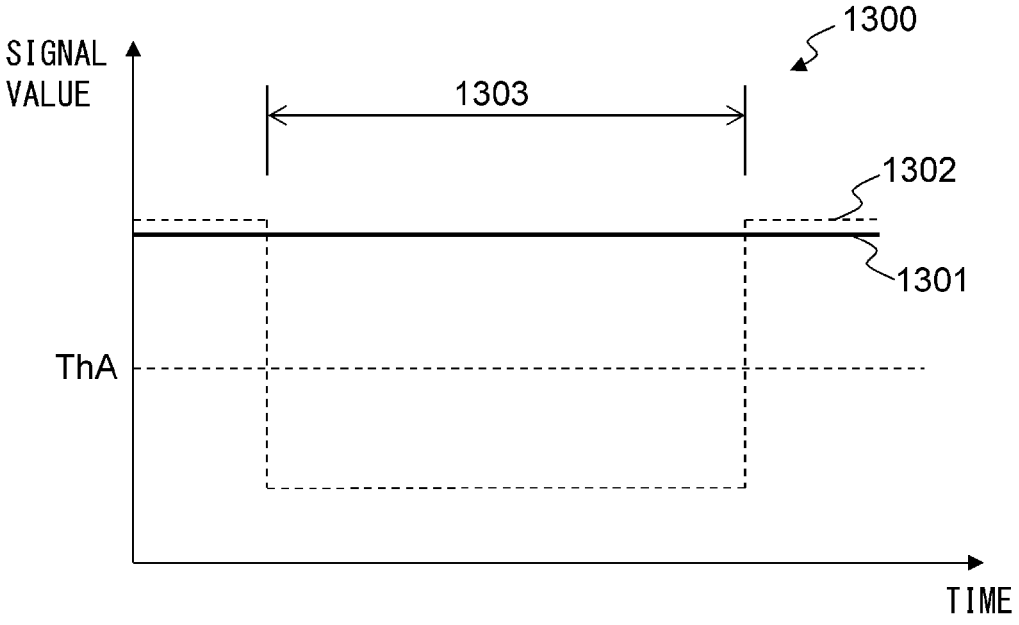
FIG. 13 a view for explaining properties of an ultrasonic signal.

FIG. 13 is a view for explaining properties of an ultrasonic signal.

In the graph 1300 of FIG. 13, the solid line 1301 shows the characteristic of the ultrasonic signal in the case where a single paper is conveyed, while the broken line 1302 shows the characteristic of the ultrasonic signal in the case where multifeed of papers has occurred. The abscissa of the graph 1300 shows the time, while the ordinate shows the signal value of the ultrasonic signal. Due to the occurrence of multifeed, the signal value of the ultrasonic signal of the broken line 1302 falls in the section 1303. For this reason, it is possible to determine whether multifeed of papers has occurred by whether the signal value of the ultrasonic signal is less than the multifeed detection threshold value ThA.

The multifeed detector 155 determines that multifeed of the papers has occurred when the signal value of the ultrasonic signal is less than the multifeed detection threshold value (step S503), determines that multifeed of the papers has not occurred when the signal value of the ultrasonic signal is the multifeed detection threshold value or more (step S504), and ends the series of steps.

As explained above in detail, the paper conveying apparatus 100 operates in accordance with the flow charts which are shown in FIG. 4, FIG. 5, and FIG. 6 to thereby correct the sound signal so as to reduce the difference in a sound signal due to the conveyance speed of a paper and thereby determine whether a jam has occurred, so it becomes possible to precisely determine any occurrence of a jam regardless of the conveyance speed of the paper.

Further, the paper conveying apparatus 100 sets the sampling rate so that the ratio of the sampling rate to the conveyance speed of the paper becomes substantially constant, so there is no longer a need to adjust the parameters for detection of a sound jam for each conveyance speed and the efficiency of development can be improved.

Figure 14:
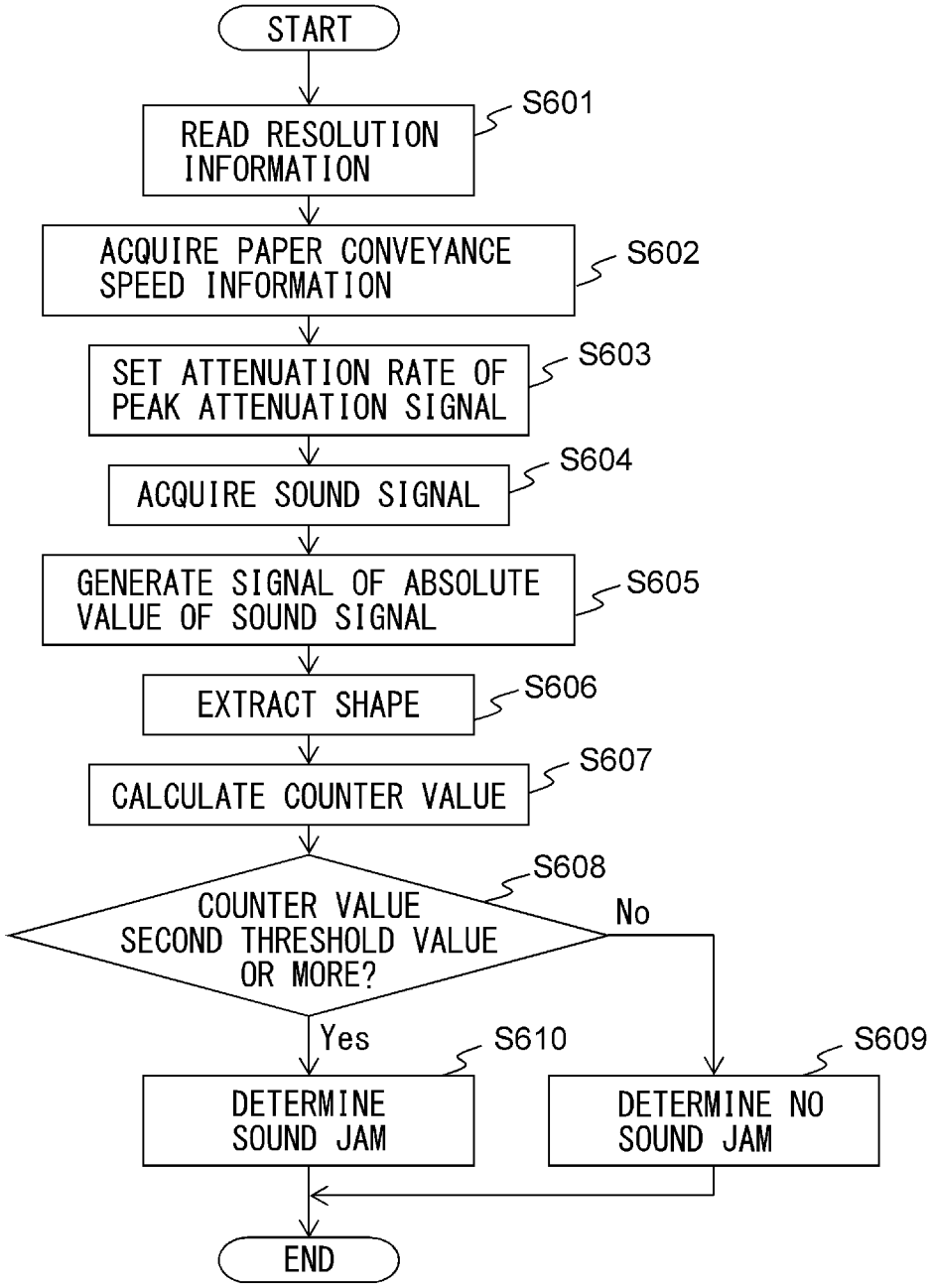
FIG. 14 is a flow chart which shows another example of operation of sound jam detection processing.

FIG. 14 is a flow chart which shows another example of operation of the sound jam detection processing.

This flow chart can be followed in the paper conveying apparatus 100 instead of the flow chart which is shown in the above-mentioned FIG. 6. In the flow chart which is shown in FIG. 14, unlike the flow chart which is shown in FIG. 6, the corrected signal generator 156 sets the attenuation rate of the peak attenuation signal in accordance with the conveyance speed so as to generate the corrected signal instead of setting the sampling rate in accordance with the conveyance speed. The processing of steps S601 to S602 and S604 to S610 which are shown in FIG. 14 is the same as the processing of steps S301 to S302 and S304 to S310 which are shown in FIG. 6, so the explanations will be omitted and only the processing of step S603 will be explained below.

At step S603, the corrected signal generator 156 sets the attenuation rate of the peak attenuation signal in accordance with the conveyance speed information which the conveyance speed information acquisition module 157 has acquired. The attenuation rate is set so that the degree of attenuation becomes larger the faster the conveyance speed, so that the degree of attenuation becomes smaller the slower the conveyance speed, and so that therefore the ratio of the degree of attenuation to the conveyance speed becomes substantially constant (for example, $1/(15\times2^{12})$ per ppm). For example, the attenuation rate when the conveyance speed is 60 ppm is set to $\{(2^{10}-1)/(2^{10})\}=0.999023$ so that the signal attenuates by $\{1/(2^{10})\}$ at a time, while the attenuation rate when the conveyance speed is 15 ppm is set to $\{(2^{12}-1)/(2^{12})\}=0.999755$ so that the signal attenuates by $\{1/(2^{12})\}$ at a time.

Due to this, in the corrected signal, the signal value at the time of movement by the paper by exactly the same distance from when a peak value appears can be set to be substantially constant regardless of the conveyance speed of the paper, so the corrected signal generator 156 can generate a corrected signal so that the shape does not change due to the conveyance speed of the paper. Therefore, the sound jam detector 153 can determine whether a sound jam has occurred based on the corrected signal without changing the content of detection processing by the conveyance speed of the paper.

If setting the attenuation rate in accordance with the conveyance speed in the same way as the sampling rate, the amount of attenuation between the peak values changes in the peak attenuation signal, but there is little possibility of mistakenly determining that a jam has occurred due to a sound smaller than the sound generated due to a jam or a sound much shorter in duration of generation. Therefore, by setting the attenuation rate so that the ratio of the degree of attenuation of the peak attenuation signal to the conveyance speed of the paper can be substantially constant, it is possible to precisely determine any occurrence of a jam regardless of the conveyance speed of the paper.

Figure 15A:
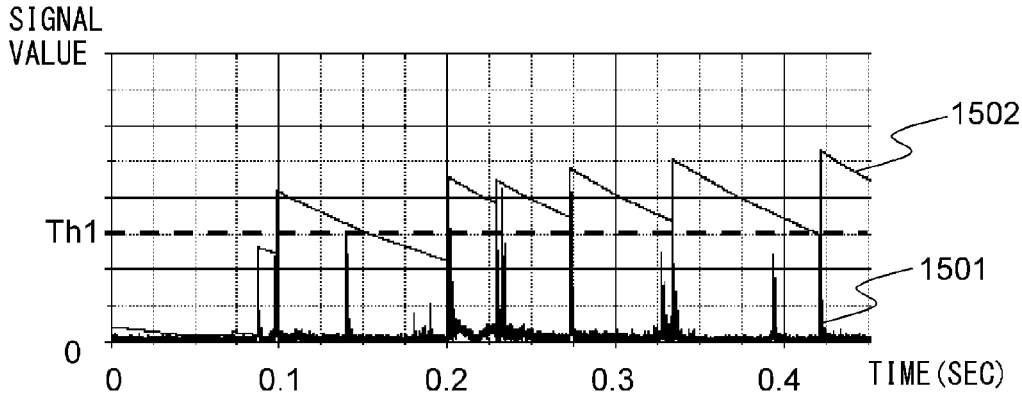
FIG. 15A is a view for explaining sound jam detection at the time of changing an attenuation rate.
Figure 15B:
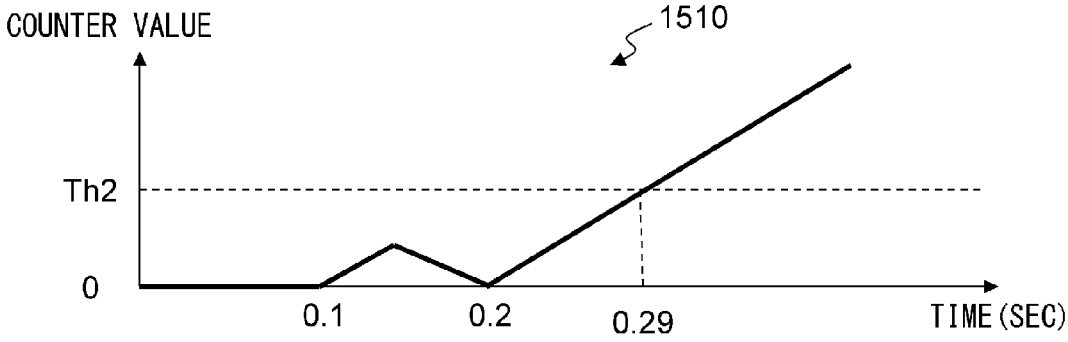
FIG. 15B is a view for explaining sound jam detection at the time of changing an attenuation rate.

FIG. 15A and FIG. 15B are views for explaining detection of a sound jam when the attenuation rate of the peak attenuation signal is changed.

In FIG. 15A and FIG. 15B, the abscissa shows the time, while in FIG. 15A, the ordinate shows the signal value of the sound signal and in FIG. 15B, the ordinate shows the counter value. The signal 1501 of FIG. 15A shows the signal of the absolute value of the sound signal 1001 of FIG. 10A, while the signal 1502 shows the peak attenuation signal which is extracted as the corrected signal of the signal 1501. The graph 1510 of FIG. 15B expresses the counter value which is calculated for the peak attenuation signal 1502 of FIG. 15A.

The signal 1901 of FIG. 15A, like the signal 1011 of FIG. 10A, is the signal of the absolute value of the sound signal when a paper is conveyed by a low speed (16 ppm), but the sampling rate is set to 96 kHz. However, the peak attenuation signal 1012 of FIG. 10A is attenuated by an attenuation rate of $\{(2^{10}-1)/(2^{10})\}=0.999023$, while the peak attenuation signal 1502 of FIG. 15A is attenuated by an attenuation rate of $\{(2^{12}-1)/(2^{12})\}=0.999755$.

Due to this, in the peak attenuation signal 1502, after the time 0.2 second and before the peak value attenuates to less than the first threshold value Th1, the next peak value appears and the peak attenuation signal 1502 constantly becomes the first threshold value Th1 or more. For this reason, as shown in FIG. 15B, the counter value increases after the time 0.2 second and becomes the second threshold value Th2 or more at the time 0.29 second, so it is determined that a sound jam has occurred.

As explained above in detail, the paper conveying apparatus 100 operates in accordance with the flow charts which are shown in FIG. 4, FIG. 5, and FIG. 14 so as to set the attenuation rate of the peak attenuation signal to correct the sound signal so as to reduce the difference in the sound signal due to the conveyance speed of the paper, so it becomes possible to precisely determine any occurrence of a jam by a jam sound regardless of the conveyance speed of the paper.

Further, the paper conveying apparatus 100 sets the attenuation rate so that the ratio of the degree of attenuation of the peak attenuation signal to the conveyance speed of a paper becomes substantially constant, so there is no longer a need to adjust the parameters for detection of a sound jam for each conveyance speed and the efficiency of development can be improved.

Figure 16:
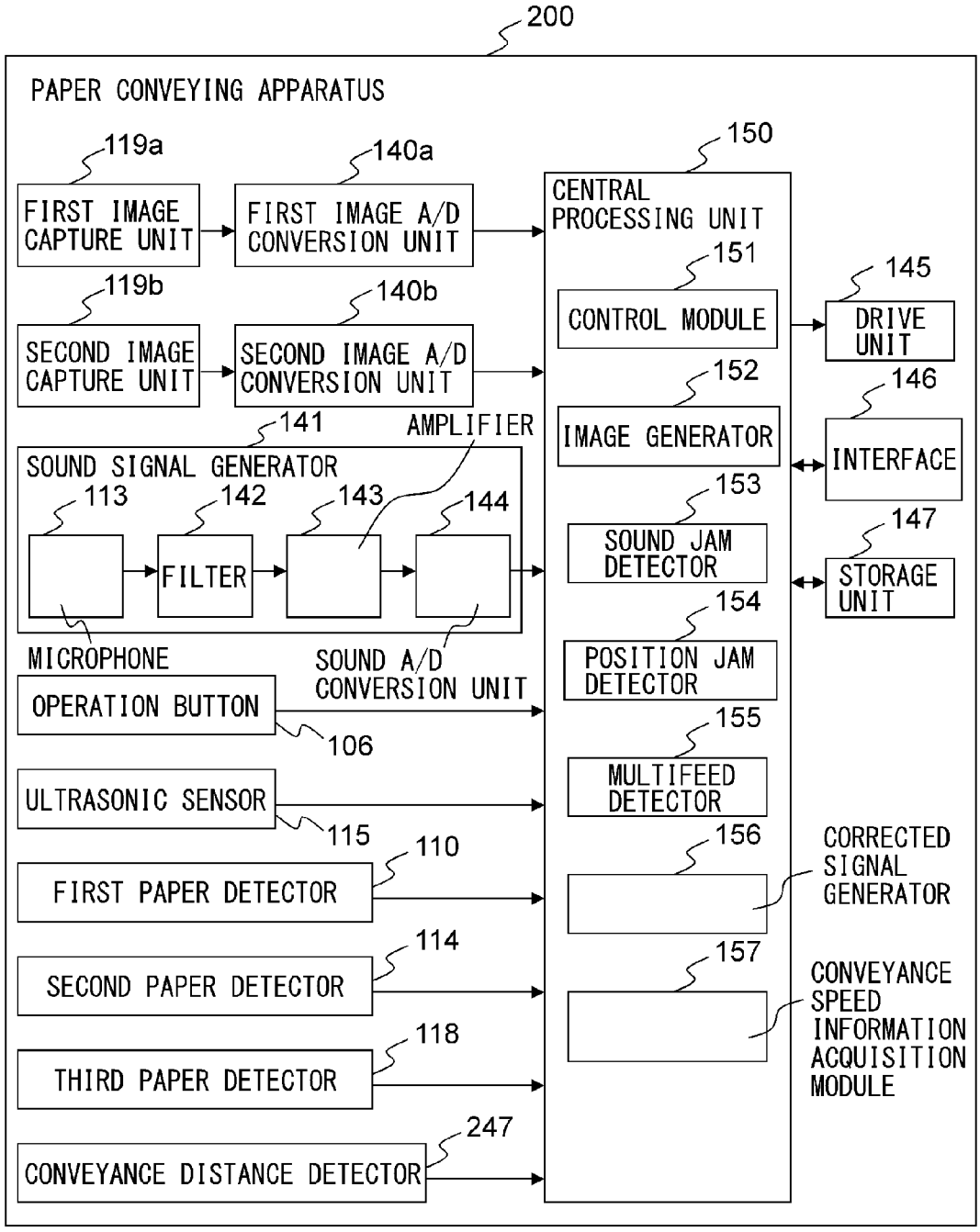
FIG. 16 is a block diagram which shows the schematic configuration of a paper conveying apparatus 200 corresponding to another embodiment.

FIG. 16 is a block diagram which shows the schematic configuration of a paper conveying apparatus 200 corresponding to another embodiment.

The paper conveying apparatus 200 which is shown in FIG. 16 has a conveyance distance detector 247 in addition to the parts of the paper conveying apparatus 100 which is shown in FIG. 3. The conveyance distance detector 247 has a rotary encoder which is arranged so as to rotate along with the paper feed roller 111 and detects the conveyance distance of the paper by the rotational angle of the rotary encoder. The conveyance distance detector 247 outputs information which shows the rotational angle of the rotary encoder at a predetermined time interval to the central processing unit 150.

The conveyance speed information acquisition module 157 acquires the conveyance speed information of the paper from the information which shows the rotational speed of the rotary encoder which is acquired from the conveyance distance detector 247 at predetermined time intervals and the time at which the information is acquired. The corrected signal generator 156 generates a corrected signal in accordance with the conveyance speed information which is acquired by the conveyance speed information acquisition module 157.

Note that, the paper conveying apparatus 200 may acquire the conveyance speed information based on the rotational speed of the motor instead of acquiring the conveyance speed information based on the conveyance distance of the paper. In this case, the drive unit 145 outputs the information which shows the rotational speed of the motor to the central processing unit 150. Further, the conveyance speed information acquisition module 157 acquires the conveyance speed information of the paper from the information which shows the rotational speed of the motor which is acquired from the drive unit 145.

As explained above in detail, the paper conveying apparatus 200 can acquire the conveyance speed of the paper from the conveyance distance of the paper or the rotational speed of the motor so as to acquire the conveyance speed of the paper in real time even if the conveyance speed fluctuates due to the conveyance load such as in the case of using a DC (direct current) motor and can correct the sound signal in accordance with that the conveyance speed, so can precisely determine any occurrence of a jam by a jam sound regardless of the conveyance speed of the paper.

According to the paper conveying apparatus and the jam detection method, and the computer-readable, non-transitory medium, the sound signal is corrected in accordance with the conveyance speed information of the paper and it is determined whether a jam has occurred based on the corrected signal, so it becomes possible to precisely determine any occurrence of a jam by a jam sound regardless of the conveyance speed of the paper.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiment(s) of the present inventions have been described in detail, it should be understood that the various changes, substitutions, and alterations could be made hereto without departing from the spirit and scope of the invention.

What is claimed is:

1. A paper conveying apparatus comprising:

a sound signal generator for generating a sound signal by sampling a sound generated by a paper during conveyance of the paper by a predetermined sampling rate;

a conveyance speed information acquisition module for acquiring a conveyance speed of the paper;

a corrected signal generator for extracting a shape of the sound signal by attenuating a peak value of the sound signal at a predetermined attenuation rate in every sampling interval to generate a corrected signal; and a sound jam detector for determining whether a jam has occurred based on the corrected signal, wherein the corrected signal generator sets the predetermined sampling rate in such a manner that the predetermined sampling rate is higher as the conveyance speed is faster, and the predetermined sampling rate is lower as the conveyance speed is slower.

2. The paper conveying apparatus according to claim 1, further comprising a storage unit for storing scanning information input by a user, wherein the conveyance speed information acquisition module acquires the conveyance speed based on the scanning information.

3. The paper conveying apparatus according to claim 2, wherein the scanning information is information about a resolution for scanning a paper.

4. The paper conveying apparatus according to claim 1, further comprising a motor for rotating a roller which conveys a paper, wherein the conveyance speed information acquisition module acquires the conveyance speed based on a rotational speed of the motor.

5. The paper conveying apparatus according to claim 1, further comprising a conveyance distance detector for detecting a conveyance distance of the paper, wherein the conveyance speed information acquisition module acquires the conveyance speed based on the conveyance distance.

6. The paper conveying apparatus according to claim 1, wherein the sound jam detector determines whether the jam has occurred based on the corrected signal using the same threshold value regardless of the conveyance speed.

7. A paper conveying apparatus comprising:

a sound signal generator for generating a sound signal by sampling a sound generated by a paper during conveyance of the paper by a predetermined sampling rate;

a conveyance speed information acquisition module for acquiring a conveyance speed of the paper;

a corrected signal generator for extracting a shape of the sound signal by making a peak value of the sound signal attenuate at a predetermined attenuation rate in every sampling interval to generate a corrected signal; and a sound jam detector for determining whether a jam has occurred based on the corrected signal, wherein the corrected signal generator sets the predetermined attenuation rate in such a manner that a degree of attenuation is larger as the conveyance speed is faster, and the degree of attenuation is smaller as the conveyance speed is slower.

8. A computer-readable, non-transitory medium storing a computer program, wherein the computer program causes a computer to execute a process, the process comprising:

acquiring a sound signal from a sound signal generator for generating the sound signal by sampling a sound generated by a paper during conveyance of the paper by a predetermined sampling rate;

acquiring conveyance speed of a paper;

extracting a shape of the sound signal by attenuating a peak value of the sound signal at a predetermined attenuation rate in every sampling interval to generate a corrected signal; and determining whether a jam has occurred based on the corrected signal, wherein the computer sets the predetermined sampling rate in such a manner that the predetermined sampling rate is higher as the conveyance speed is faster, and the predetermined sampling rate is lower as the conveyance speed is slower.

9. A computer-readable, non-transitory medium storing a computer program, wherein the computer program causes a computer to execute a process, the process comprising:

acquiring a sound signal from a sound signal generator for generating the sound signal by sampling a sound generated by a paper during conveyance of the paper by a predetermined sampling rate;

acquiring conveyance speed of a paper;

extracting a shape of the sound signal by attenuating a peak value of the sound signal at a predetermined attenuation rate in every sampling interval to generate a corrected signal; and determining whether a jam has occurred based on the corrected signal, wherein the computer sets the predetermined attenuation rate in such a manner that a degree of attenuation is larger as the conveyance speed is faster, and the degree of attenuation is smaller as the conveyance speed is slower.

* * * * *